US006167642B1

(12) United States Patent
Nardini

(10) Patent No.: US 6,167,642 B1
(45) Date of Patent: Jan. 2, 2001

(54) TRACTOR BUCKET EXTENSION DEVICE AND METHOD

(76) Inventor: Mark A. Nardini, 194 Old Mariaville Rd., Schenectady, NY (US) 12306

( * ) Notice: Under 35 U.S.C. 154(b), the term of this patent shall be extended for 0 days.

(21) Appl. No.: 09/339,322

(22) Filed: Jun. 23, 1999

(51) Int. Cl.[7] ..... E02F 3/76
(52) U.S. Cl. ..... 37/403; 37/903
(58) Field of Search ..... 37/446, 410, 903, 37/DIG. 3, DIG. 12, 466, 467, 403; 414/718, 722, 912; 172/824, 825, 821, 819

(56) References Cited

U.S. PATENT DOCUMENTS

| | | | | |
|---|---|---|---|---|
| 3,598,266 | * | 8/1971 | Fisher | 414/145 |
| 3,938,680 | | 2/1976 | Grimes . | |
| 4,068,771 | | 1/1978 | Zimmerman . | |
| 4,208,814 | | 6/1980 | Stone . | |
| 4,234,035 | | 11/1980 | Hornstein . | |
| 4,328,628 | | 5/1982 | Thomas . | |
| 4,550,512 | | 11/1985 | Felstet . | |
| 4,813,164 | | 3/1989 | Morrell . | |
| 4,890,400 | | 1/1990 | Long . | |
| 4,999,022 | * | 3/1991 | Veys | 414/718 |
| 5,088,213 | | 2/1992 | Raimono et al. . | |
| 5,129,169 | * | 7/1992 | Aubichon | 37/231 |
| 5,165,191 | | 11/1992 | Davis . | |
| 5,172,499 | | 12/1992 | Griffin . | |
| 5,252,022 | | 10/1993 | Culp et al. . | |
| 5,315,772 | | 5/1994 | Lalonde . | |
| 5,325,615 | | 7/1994 | Hutchins et al. . | |
| 5,350,250 | | 9/1994 | Nagler . | |
| 5,367,796 | * | 11/1994 | Bowers et al. | 37/410 |
| 5,394,630 | | 3/1995 | Moinat . | |
| 5,531,036 | | 7/1996 | Shinkle . | |
| 5,560,129 | | 10/1996 | Rothbart . | |
| 5,564,885 | | 10/1996 | Staben, Jr. . | |
| 5,590,482 | | 1/1997 | Peterson et al. . | |
| 5,775,013 | | 7/1998 | Von Schalscha . | |
| 5,779,429 | | 7/1998 | Poole . | |
| 5,873,417 | | 2/1999 | Halischuk . | |

* cited by examiner

*Primary Examiner*—Robert E. Pezzuto
(74) *Attorney, Agent, or Firm*—Jay R. Yablon

(57) ABSTRACT

A loader bucket extender is attached to a preexisting loader bucket so as to extend the load-carrying capacity of that loader bucket by a large amount, on the order of fourfold and even more. A tractor or similar vehicle to which the preexisting loader bucket is attached moves the preexisting loader bucket into a suitable position relative to the loader bucket extender, at which point the loader bucket extender and preexisting loader bucket are attached and secured to one another using several engagement, attachment, and securing members.

27 Claims, 5 Drawing Sheets

TRACTOR BUCKET EXTENSION DEVICE AND METHOD

FIELD OF THE INVENTION

This invention relates generally to the fields of excavating and of earth, snow and similar load moving, and specifically, to significantly extending the load-carrying capacity of preexisting tractor buckets in a simple and low cost manner.

BACKGROUND OF THE INVENTION

Plows, forklifts, loader buckets, backhoe buckets and the like are of course well know in the art and widely used in many different applications. But such load moving equipment is expensive, and involves considerable capital investment. Thus, it is desirable to have available adapters of various sorts that convert one type of load-carrying device into another, and/or which extend the capacity of preexisting load-carrying devices. This reduces cost and equipment inventory for individuals or businesses involved in the excavating and load moving professions.

U.S. Pat. No. 4,890,400, for example, appears to be used to convert a preexisting tractor plow blade into a load-carrying bucket. Pivot supports (numbered 38 and 40 therein) are attached to the plow blade, central holes of pivot supports (numbered 44, 45 and 47 therein) are axially aligned with supports 38 and 40, and a pivot shaft (52) is slid through all of the axially-aligned holes to secure the bucket structure to the plow blade. The capacity of the resulting bucket structure is, however, limited by the size of the preexisting plow blade, and no means is suggested or disclosed for further increasing the load-carrying capacity of the resulting plow blade and bucket structure combination to carry even larger loads. Nor is it disclosed or suggested that it is indeed desirable to extend preexisting loader buckets generally to carry larger loads. Nor is it disclosed or suggested how to extend preexisting loader buckets to carry larger loads. And, the method by which the bucket attachment is attached to the plow blade in U.S. Pat. No. 4,890,400 is cumbersome, requiring all of the holes to first be aligned, and the pivot shaft to be manually slid through the aligned holes.

U.S. Pat. No. 3,938,680 appears to disclose a loader bucket attachment that extends either the top or bottom of a preexisting loader bucket, but does not disclose or suggest how to increase the overall bucket capacity by extending the top, bottom, and side of the bucket all at once, essentially creating a much larger bucket. Indeed, this patent appears to teach away from a more general increase in loader bucket capacity that extends all of the top, bottom and sides of the loader bucket.

U.S. Pat. No. 4,068,771 appears to disclose a loader bucket attachment that coverts a preexisting loader bucket into a carrier bucket for carrying dispensing flowable material such as concrete. This patent does not disclose or suggest how to extend loader bucket capacity generally, and its structure limits its usefulness to carrying and dispensing flowable material such as concrete, not to load-carrying generally. Indeed, the front wall (numbered 20 therein) makes it impossible for this device in combination with the preexisting loader bucket to work strictly as an enlarged conventional loader bucket.

U.S. Pat. No. 4,208,814 appears to disclose a device for extending the width and capacity of a backhoe (not a loader) bucket. However, the percentage increase in volume achieved by this device is equal to the percentage increase in width, and is thus very much limited by the width of the backhoe. It is not disclosed or suggested how to increase loader bucket capacity generally without increasing the width, but rather by increasing the top, bottom and side extensions all at once. In this patent, for an extender that is perhaps 33% as wide as the original backhoe bucket (which is approximately what is illustrated therein), the capacity increase will also be about 33%.

Extension of the front, top, and side extensions of a loader bucket, in contrast, can easily achieve a fourfold capacity increase, and even more.

OBJECTS OF THE INVENTION

It would be desirable, therefor, to provide a device and method that can be used to easily extend the load-carrying capacity of a preexisting loader bucket to 300% or 400% or more of its original capacity.

It would further be desirable if this device and the method of attaching this device to the preexisting loader bucket was as simple and quick as possible, permitting a bucket extending device to easily be snapped into place by a human tractor driver without the tractor driver having to disembark the tractor controls to complete the primary attachment of the bucket extender to the preexisting loader bucket.

SUMMARY OF THE INVENTION

A loader bucket extender is attached to a preexisting loader bucket so as to extend the load-carrying capacity of that loader bucket by a large amount, on the order of fourfold and even more. A tractor or similar vehicle to which the preexisting loader bucket is attached moves the preexisting loader bucket into a suitable position relative to the loader bucket extender, at which point the loader bucket extender and preexisting loader bucket are attached and secured to one another using several engagement, attachment, and securing members.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION OF THE INVENTION

Figure 1:
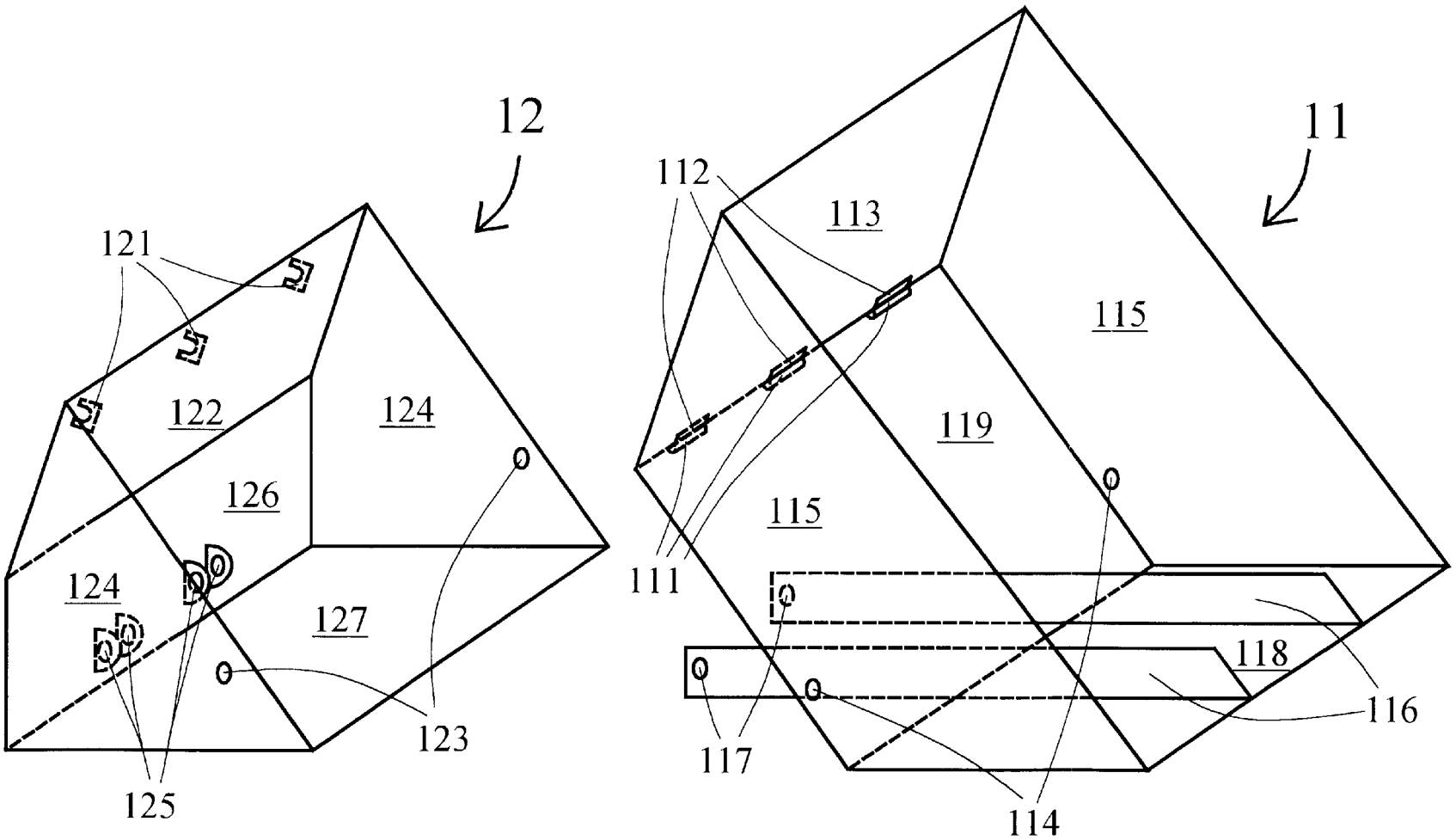
FIG. 1 is a perspective view illustrating a preexisting loader bucket, and a loader bucket extender, as separate modules unattached to one another, according to an embodiment of the invention.

FIG. 1 illustrates a loader bucket extender 11, as well as a preexisting loader bucket 12, in a first preferred embodiment of the invention, configured in such a manner that these may be attached to one another as will be further described herein. All components used to attach loader bucket extender 11 with preexisting loader bucket 12 are illustrated in FIG. 1; those that would be hidden in the particular perspective view of FIG. 1 are illustrated in dashed lines.

Preexisting loader bucket 12 in this embodiment is retrofitted with three distinct components so that it may be easily and securely mated and attached with and to loader bucket extender 11. First, upper wall bucket extender engagement means comprising but not limited to, for example, a plurality of bucket engagement latches 121 are firmly and permanently attached to an upper wall 122 of loader bucket 12. Second, a side wall bucket extender engagement means comprising but not limited to, for example, a pair of loader bucket side wall securing apertures 123 are drilled into side walls 124 of loader bucket 12. Third, lower wall bucket extender engagement means comprising but not limited to, for example, a plurality of rear wall securing eyelets 125 are firmly and permanently attached to a rear wall 126 of loader bucket 12.

Preferably, the attachment of bucket engagement latches 121 and rear wall securing eyelets 125 to loader bucket 12 is achieved by welding bucket engagement latches 121 and rear wall securing eyelets 125 to loader bucket 12 substantially as shown; however, other attachment means known in the art that provide a similar degree of permanent and secure attachment as a weld, such as bolting or riveting, are also suitable for this purpose.

Corresponding to the bucket engagement latches 121, loader bucket side wall securing apertures 123, and rear wall securing eyelets 125 illustrated above, loader bucket extender 11 is provided with three distinct components so that it may be easily and securely mated and attached with and to loader bucket 12.

First, a plurality of upper wall bucket engagement means comprising but not limited to, for example, bucket attachment engagement bars 111 with adjacent engagement bar notches 112 are provided proximate an upper wall 113 of loader bucket extender 11. These engage with and attach to bucket engagement latches 121, as will be shortly described. Second, side wall bucket engagement means comprising but not limited to, for example, a pair of bucket attachment side wall securing apertures 114 are provided on side walls 115 of loader bucket extender 11. These mate with and attach to loader bucket side wall securing apertures 123, as will be shortly described. Third, lower wall bucket engagement means comprising but not limited to, for example, a pair of bucket attachment securing arms 116 with rear wall securing apertures 117 are provided on a lower wall 118 of loader bucket extender 11, substantially as shown. These mate with and attach to rear wall securing eyelets 125, as will be shortly described. Bucket attachment securing arms 116 are permanently attached to lower wall 118 of loader bucket extender 11, but extend beyond a rear opening 119 of loader bucket extender 11, as shown. It is important to note that rear opening 119 is indeed fully open, so that loader bucket extender is essentially a four-sided unit comprising upper wall 113, lower wall 118, and side walls 115, which is open on its fifth and sixth sides, namely, rear opening 119, as well as its front opening (unnumbered).

While three bucket engagement latches 121 and bucket attachment engagement bars 111 with adjacent engagement bar notches 112 are shown, any plurality of such latches 121, bars 111 and notches 112 is suitable for, and within the scope of, this invention. Similarly, while four rear wall securing eyelets 125 and two bucket attachment securing arms 116 with rear wall securing apertures 117 are shown, any plurality of such arms 116 and apertures 117 is suitable for, and within the scope of, this invention.

Figure 2:
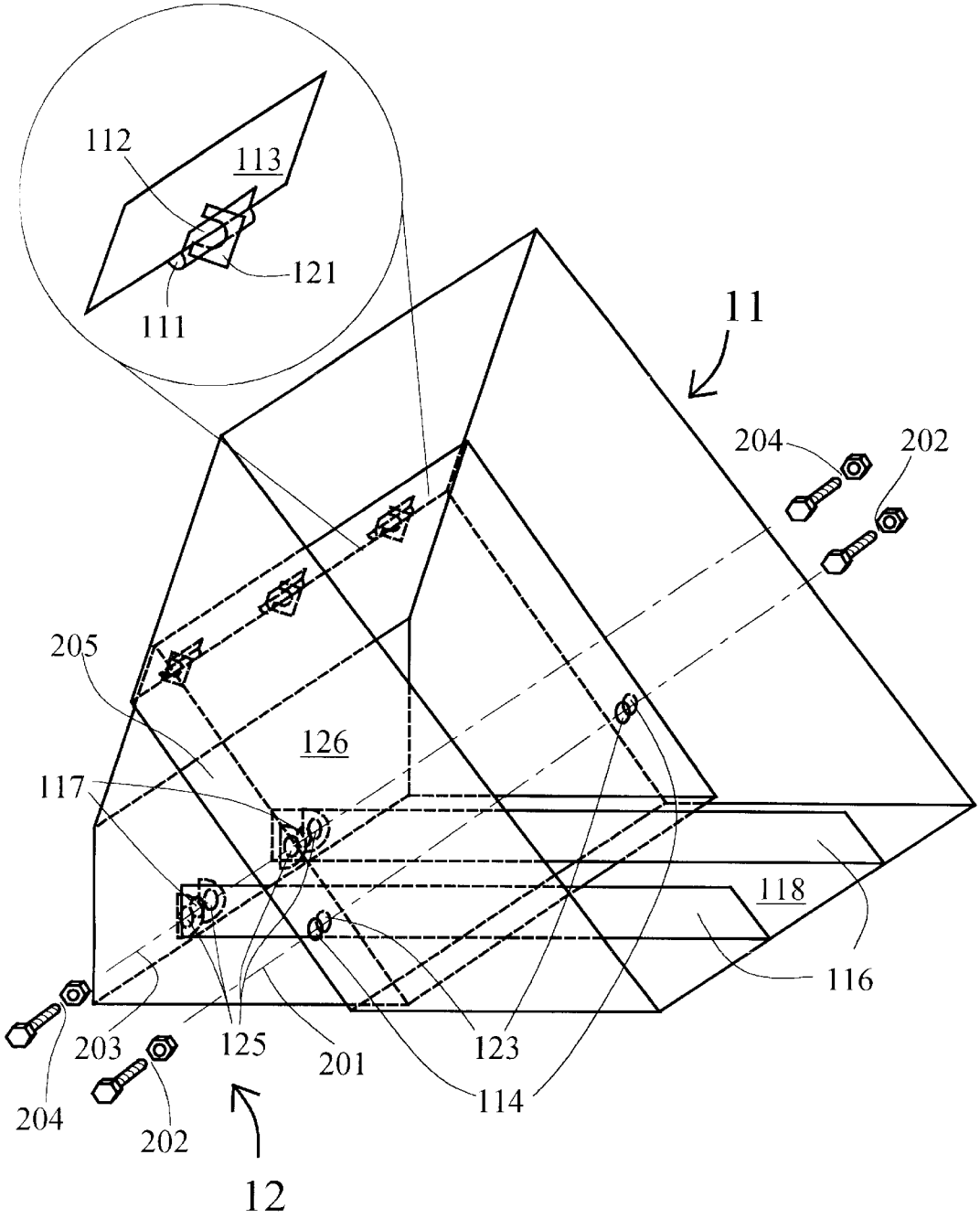
FIG. 2 is a perspective view illustrating the combination of the preexisting loader bucket and the loader bucket extender of the embodiment of FIG. 1, once they have been attached to one another.
Figure 4:
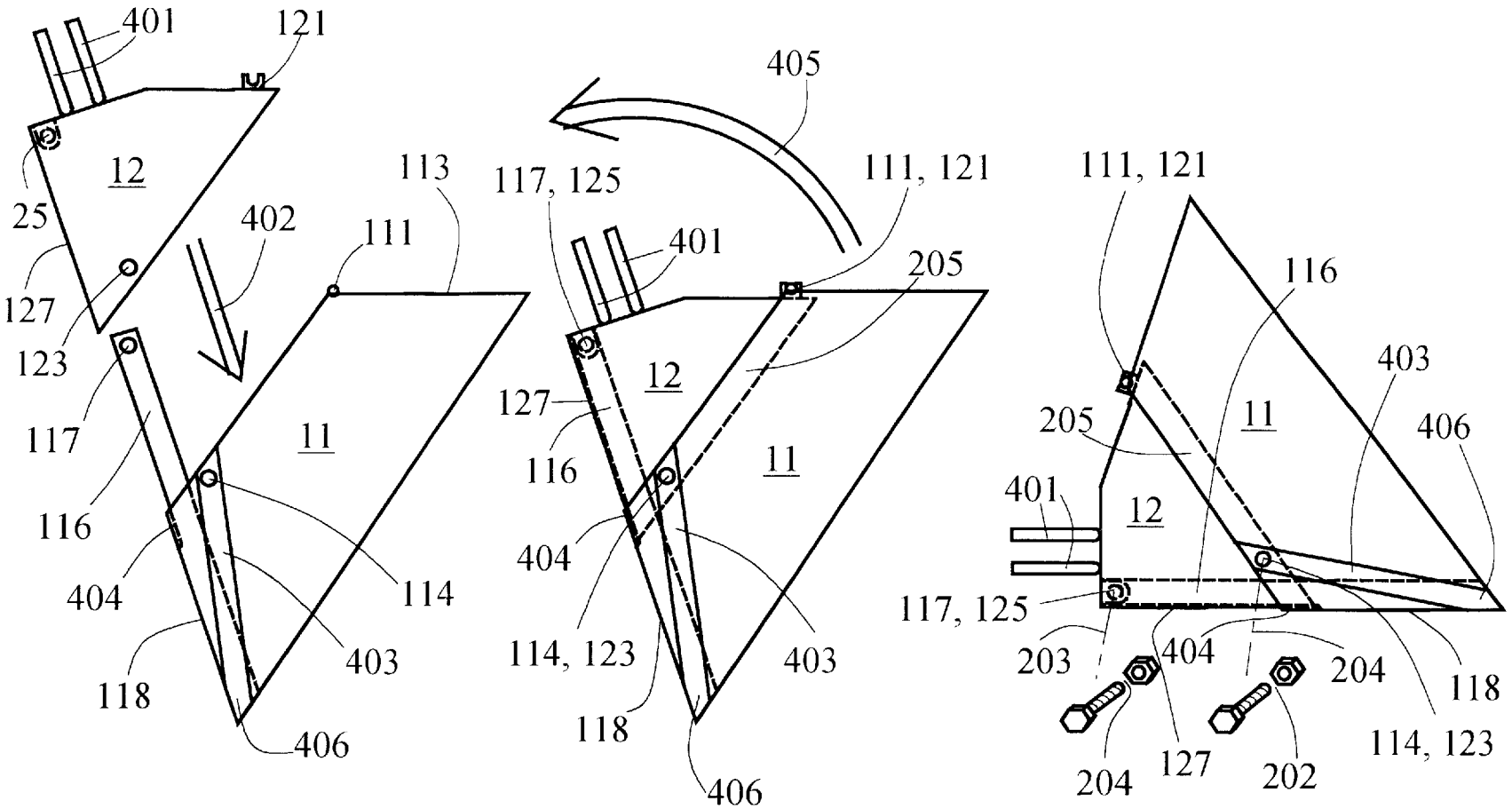
FIG. 4 is a side cross-sectional view which illustrates the method by which the attachment of FIG. 2 is achieved.

FIG. 2 illustrates the configuration of preexisting loader bucket 12 and loader bucket extender 11 of the embodiment of FIG. 1, once they have been attached to one another. This attachment has three primary regions of contact. FIG. 4 illustrates the method by which this attachment is achieved.

First, referring to FIG. 2, it is to be observed that bucket engagement latches 121 engage and are mated with bucket attachment engagement bars 111. In particular, as shown in the enlargement toward the upper left of FIG. 2, the recessed sections of bucket engagement latches 121 wrap around and interlock with bucket attachment engagement bars 111, and engagement bar notches 112 accommodate the protruding sections of bucket engagement latches 121. Because bucket engagement latches 121 are affixed to upper wall 122 of loader bucket 12, this creates a firm mate between preexisting loader bucket 12 and loader bucket extender 11 along the upper wall 122 of loader bucket 12 and the upper wall 113 of loader bucket extender 11. This upper wall contact region is the first primary region of contact attaching preexisting loader bucket 12 and loader bucket extender 11.

Second, bucket attachment side wall securing apertures 114 line up with loader bucket side wall securing apertures 123 along side wall alignment line 201. Then, any suitable, durable side wall securing means 202 such as, but not limited to, the illustrated nuts and bolts, or a suitable securing bar, are used to secure the left side bucket attachment side wall securing aperture 114 to the left side loader bucket side wall securing apertures 123, and similarly for the right side apertures 114 and 123. These side wall contact regions comprise the second primary region of contact attaching preexisting loader bucket 12 and loader bucket extender 11.

Third, rear wall securing apertures 117 of bucket attachment securing arms 116 line up with rear wall securing eyelets 125 along rear wall alignment line 203, proximate rear wall 126 of loader bucket 12. Here too, any suitable, durable rear wall securing means 204 such as, but not limited to, the illustrated nuts and bolts, or a suitable securing bar, are used to secure securing apertures 117 to rear wall securing eyelets 125. By virtue of the attachment of securing arms 116 to lower wall 118 of loader bucket extender 11 and the extension of securing arms 116 all the way to rear wall 126 of loader bucket 12, this serves to secure lower wall 118 of loader bucket extender 11 to rear wall 126 of loader bucket 12. The lower and rear wall contact regions comprise the third primary region of contact attaching preexisting loader bucket 12 and loader bucket extender 11.

Also denoted in FIG. 2 is overlap 205 region where loader bucket extender 11 and preexisting loader bucket 12 overlap once they are assembled together.

Once preexisting loader bucket 12 and loader bucket extender 11 are attached to one another along the three contact regions as described above, the combination of preexisting loader bucket 12 and loader bucket extender 11 results in a greatly-enlarged bucket, which can be used to carry a much larger load than preexisting loader bucket 12 by itself. In particular, for a given left side to right side width, it is to be noted that the overall volume of preexisting loader bucket 12 is proportional to the cross sectional area of its side walls 124, while the overall volume of the combination of preexisting loader bucket 12 and loader bucket extender 11 is proportional to the cross sectional area of the side walls 124 and 115 together.

Figure 3:
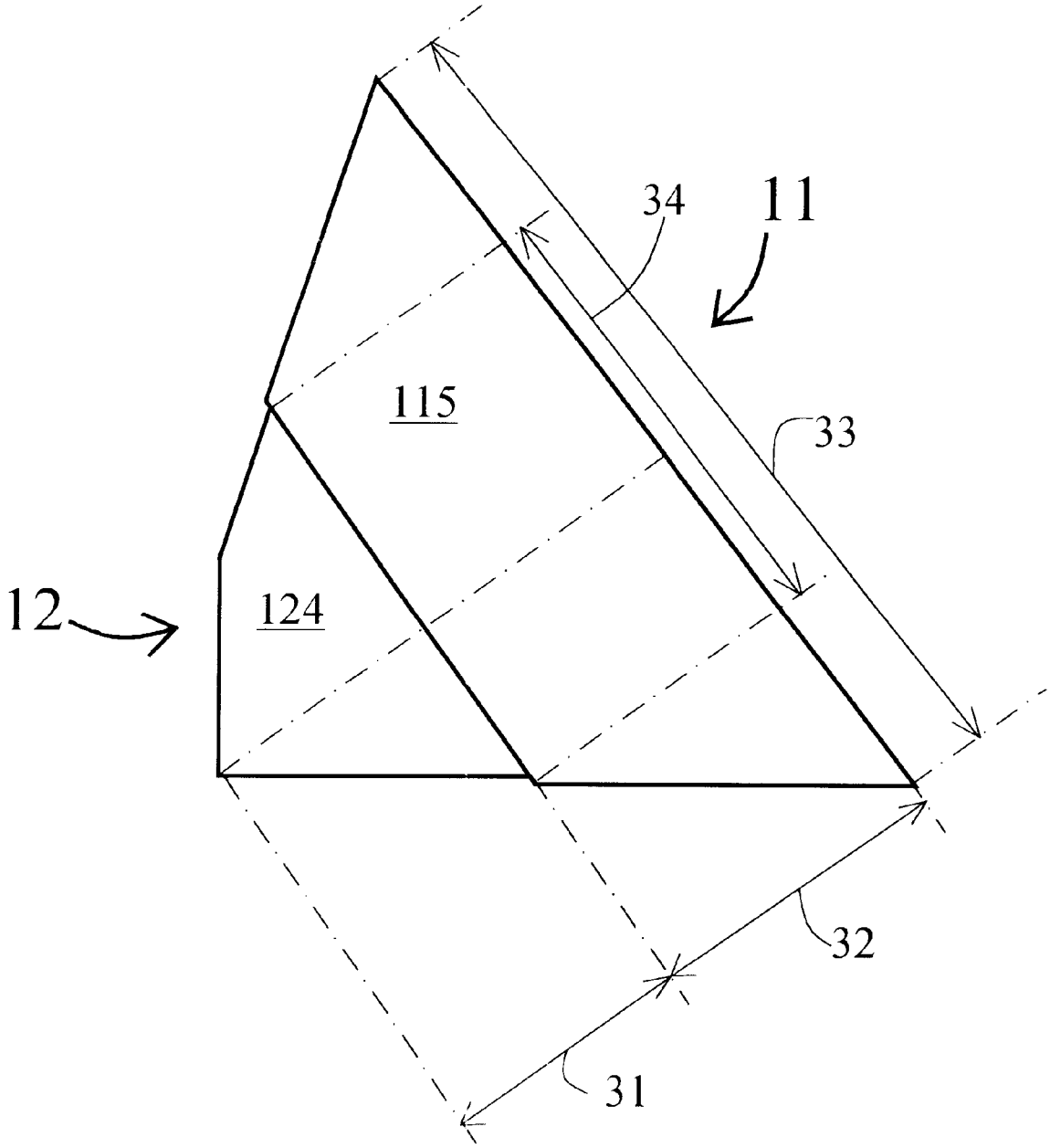
FIG. 3 is a geometric cross-sectional view of the preexisting loader bucket and loader bucket extender combination of FIG. 2, illustrating the increase in loader volume achieved by virtue of utilizing the loader bucket extender of the various embodiments of the invention.

Referring to FIG. 3, if both preexisting loader bucket 12 and the combination of bucket 12 and extender 11 are approximated to be triangular in shape, then these cross sectional areas are in turn proportional to the base of the pertinent triangle, times the height of the pertinent triangle. If the original volume is then designated by $V_1$ and the extended volume is designated by $V_2$, if $b_1$ designates the base 34 of preexisting loader bucket 12, if $b_2$ designates the base 33 of loader bucket extender 11, if $h_1$ designates the height 31 of preexisting loader bucket 12, and if $h_2$ designates the combined height 31 plus 32 of the combination of preexisting loader bucket 12 and loader bucket extender 11, then:

$$V_2/V_1 \sim b_2 \times h_2/b_1 \times h_1. \quad (1)$$

It is also to be noted that by regarding these cross sections as triangles, b2 will vary with h2, and b1 with h1, so that eq. (1) simplifies to:

$$V_2/V_1 \sim b_2^2/b_1^2 \sim h_2^2/h_1^2. \quad (2)$$

Thus, for example, if height 32 of loader bucket extender 11 simply equals height 31 of preexisting loader bucket 12, then V2/V1~4, i.e., the total volume of the buckets will be quadrupled. If height 32 of loader bucket extender 11 equals twice the height 31 of preexisting loader bucket 12, then V2/V1~9. So, in contrast for example to U.S. Pat. Nos. 3,938,680 and 4,208,814, the present invention achieves a very substantial increase in capacity that is easily fourfold, if not more. And, this is to be contrasted with U.S. Pat. No. 4,890,400, which takes a plow that has zero load-carrying capacity and gives it some, limited, load-carrying capacity. Indeed, the present invention can be suitably used in an obvious manner to add load-carrying capacity to a plow that has previously been fitted with the invention of U.S. Pat. No. 4,890,400, simply by treating the conversion module of U.S. Pat. No. 4,890,400 as preexisting loader bucket 12 of the present disclosure.

FIG. 4 illustrates in cross sectional view, from left to right, the process by which loader bucket extender 11 and preexisting loader bucket 12 are attached to one another to achieve the resultant configuration of FIG. 2. It is understood that preexisting loader bucket 12 is attached to a tractor or similar vehicle (not shown) via vehicle connection means 401 which allow preexisting loader bucket 12 to be moved up and down, forward and backward, and also, to be rotated.

Loader bucket extender 11 is rested substantially at the orientation shown on the leftmost drawing of FIG. 4 prior to its attachment to preexisting loader bucket 12, with lower front region 406 of loader bucket extender 11 resting upon a supporting surface (e.g., the ground) and upper wall 113 of loader bucket extender 11 oriented substantially horizontally above that supporting surface. Vehicle connection means 401 is used to raise preexisting loader bucket 12 above loader bucket extender 11 substantially as shown, and to also rotationally orient preexisting loader bucket 12 substantially as shown, with its upper wall 122 also running substantially horizontally above the supporting surface. In particular, it is to be noted that this results in bucket engagement latches 121 being positioned substantially above preexisting loader bucket 12 with the recessed sections of bucket engagement latches 121 oriented upwards.

Vehicle connection means 401 is then used to lower preexisting loader bucket 12 downward, substantially as illustrated by arrow 402. It is to be observed that in this embodiment, as was also depicted in FIG. 2, proximate overlap 205 region where loader bucket extender 11 and preexisting loader bucket 12 overlap once they are assembled together, the overlapping section of preexisting loader bucket 12 actually resides inside the region of loader bucket extender 11 with which it overlaps. Thus, preexisting loader bucket 12 is lowered downward 402 and into loader bucket extender 11 as shown, and fine-movement adjusted as needed. During this lowering 402, preexisting loader bucket 12 is lowered 402 such that bucket attachment securing arms 116 slide into the interior of preexisting loader bucket 12 proximate lower wall 127 of preexisting loader bucket 12, and such that bucket engagement latches 121 drop slightly below bucket attachment engagement bars 111. Once this configuration is achieved, preexisting loader bucket 12 is raised slightly, until bucket engagement latches 121 firmly engage and mate with bucket attachment engagement bars 111. Part of bucket engagement latches 121 may, depending on the specific implementation, protrude through engagement bar notches 112 as shown in the exploded section of FIG. 2, as well as the cross section in the center and rightmost drawings of FIG. 4. The resulting configuration is that of the center drawing of FIG. 4.

It is to be observed from these cross-sectional views that bucket attachment securing arms 116 have a notched region 404 that engage the overlapping lower wall 127 (see FIG. 1) of preexisting loader bucket 12. For simplicity, this notched region 404 was omitted from earlier FIGS. 1 and 2. It is also to be observed that in this configuration, rear wall securing apertures 117 become fully aligned with rear wall securing eyelets 125, and bucket attachment side wall securing apertures 114 become fully aligned with loader bucket side wall securing apertures 123. Yet, at this point in time, it is not yet necessary to insert and secure side wall securing means 202 or rear wall securing means 204, since the engagement of bucket engagement latches 121 with bucket attachment engagement bars 111, as well as the engagement of bucket attachment securing arms 116 with preexisting loader bucket 12 lower wall 127 allows the entire combination of loader bucket extender 11 and preexisting loader bucket 12 to be rotated along direction 405 by vehicle connection means 401 into the orientation shown in the rightmost drawing of FIG. 4, even without yet attaching side wall securing means 202 or rear wall securing means 204. This is a particular functional benefit of the embodiments of FIGS. 1 through 4, since the entire connection of loader bucket extender 11 with preexisting loader bucket 12 and orientation of this connected combination into the configuration on the rightmost drawing of FIG. 4 can be done by a person maneuvering the tractor or similar vehicle to which bucket 12 is attached via vehicle connection means 401, without that person ever having to leave the vehicle. Thus, the combination of loader bucket extender 11 and preexisting loader bucket 12 is indeed rotated into the configuration shown toward the right hand side of FIG. 4, wherein lower wall 118 of loader bucket extender 11 and lower wall 127 of preexisting loader bucket 12 are oriented substantially horizontally.

Finally, once the configuration and orientation of the rightmost drawing of FIG. 4 is achieved, side wall securing means 202 and rear wall securing means 204 are introduced respectively along side wall alignment line 201 and rear wall alignment line 203. This results in a secure attachment of loader bucket extender 11 and preexisting loader bucket 12 to one another not only at the three contact regions earlier noted, but also along lower wall 118 of loader bucket extender 11 and lower wall 127 of preexisting loader bucket 12 by virtue of the configuration of bucket attachment securing arms 116 and its interlocking relationship with preexisting loader bucket 12 lower wall 127. FIG. 4 also introduces an optional reinforcement bar 403 of loader bucket extender 11, which runs between bucket attachment side wall securing apertures 114 and lower front region 406 of loader bucket extender 11, substantially as shown. This is desirable because once the combination of loader bucket extender 11 and preexisting loader bucket 12 is used for loading, there is a fair amount of physical stress running along the path defined by reinforcement bar 403. Thus, reinforcement bar 403 serves to provide extra strength reinforcement along this high-stress region. This was not depicted in FIGS. 1 and 2, simply to keep those figures as simple as possible.

At this point, the combined assembly of loader bucket extender 11 and preexisting loader bucket 12 is fully ready for use as an extended loader, with an increase in load volume as described by eqs. (1) and (2) above.

While FIGS. 1 through 4 illustrate a particular embodiment of the invention insofar as the method and attachment means used to engage, attach and secure loader bucket extender 11 and preexisting loader bucket 12 together, it is to be understood that a wide range of variations and substitutions for achieving the same essential attachment and securing of loader bucket extender 11 to preexisting loader bucket 12 will become apparent to someone of ordinary skill based on this disclosure, and it is to be understood that any such variations and substitutions are considered to be within the scope of this disclosure and its associated claims. And it is understood that a wide variety of engagement and attachment means such as outlined in FIGS. 1 through 4 will serve this essential purpose of securely attaching loader bucket extender 11 and preexisting loader bucket 12 together within the scope of this disclosure and its associated claims.

Figure 5:
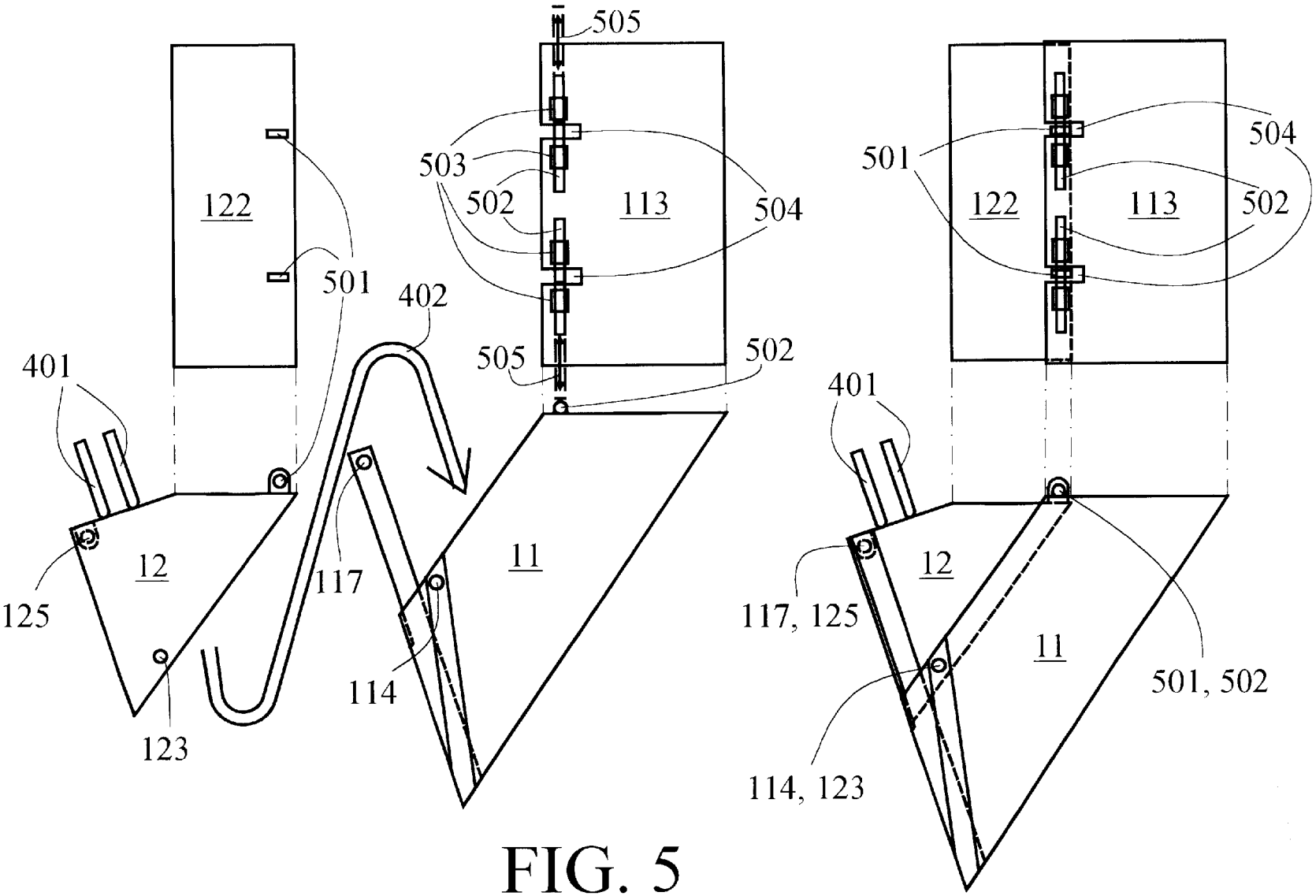
FIG. 5 are side and top cross-sectional views illustrating an alternative embodiment of the invention for attaching together the preexisting loader bucket with the loader bucket extender.

For example, not limitation, FIG. 5 illustrates an alternative embodiment of the invention using alternative engagement and attachment means, in particular, employing alternative upper wall bucket extender engagement means and upper wall bucket engagement means in place of bucket engagement latches 121 and bucket attachment engagement bars 111 for engaging loader bucket extender 11 with preexisting loader bucket 12. All other aspects of the invention apparatus and method remain substantially the same as has been heretofore described with reference to FIGS. 1 through 4.

In FIG. 5, upper wall bucket extender engagement means comprising bucket engagement latches 121 of preexisting loader bucket 12 are replaced by upper wall bucket extender engagement means comprising a plurality of bucket extender engagement eyelets 501 shown from both side and top cross-sectional views. Two are shown here, but extension to more than two is obvious and considered within the scope of the invention. Similarly, upper wall bucket engagement means comprising bucket attachment engagement bars 111 and their adjacent engagement bar notches 112 of loader bucket extender 11 are replaced by upper wall bucket engagement means comprising a plurality of slidable bucket engagement bars 502, a plurality of bucket engagement bar housings 503, and a plurality of bucket engagement cutout notches 504. Slidable bucket engagement bars 502, in particular, slide within bucket engagement bar housings 503 along the direction indicated by arrows 505. Thus, when slidable bucket engagement bars 502 are slid into the open position illustrated by the dotted lines, bucket engagement cutout notches 504 are opened up such that bucket extender engagement eyelets 501 can readily be slid into them without obstruction. It is also desirable to provide a locking means (not shown) by which bucket engagement bars 502 can be locked into their closed (solid line) position. Each slidable bucket engagement bar 502 corresponds to and mates with one of the bucket extender engagement eyelets 501, so that an alteration in the number of bucket extender engagement eyelets 501 as noted above will also alter the number of slidable bucket engagement bars 502.

As illustrated toward the left and center drawing of FIG. 5, vehicle connection means 401 is then used to lower preexisting loader bucket 12 downward, substantially as illustrated by arrow 402, as was earlier described in connection with FIG. 4. This is done while slidable bucket engagement bars 502 in their open position. Preexisting loader bucket 12 is moved and adjusted relative to loader bucket extender 11 as before. Bucket extender engagement eyelets 501 are moved into alignment with slidable bucket engagement bars 502, and slidable bucket engagement bars 502 are then slid 505 into their closed position through bucket extender engagement eyelets 501, and then locked into place. This results in the configuration shown in the rightmost drawing of FIG. 5, which it is to be noted, is identical to the middle drawing configuration of FIG. 4 except for the replacement of elements 111 and 121 with elements 501 and 502. This configuration is then rotated 405 into position for loading in the same manner as in FIG. 4, side wall securing means 202 is introduced into side wall securing apertures 114 and loader bucket side wall securing apertures 123, and rear wall securing means 204 is introduced into rear wall securing apertures 117 and rear wall securing eyelets 125, in the same way as discussed previously in connection with FIGS. 1 through 4. Once again, the combination of loader bucket extender 11 and preexisting loader bucket 12 is fully ready for use as an extended loader.

Contrasting the embodiment of FIG. 4, with FIG. 5, it is to be noted that the embodiment of FIG. 5 requires the vehicle operator to disembark the vehicle once bucket extender engagement eyelets 501 are lined up with slidable bucket engagement bars 502 in order to slide 505 slidable bucket engagement bars 502 into their closed and locked position, whereas the embodiment of FIG. 4 is fully engaged without the vehicle operator disembarking until the rightmost orientation of FIG. 4 has been achieved. This makes FIG. 4 a preferred embodiment in this regard. However, it is also to be noted that many preexisting loader buckets 12 already are manufactured and sold with eyelets such as 501 already affixed thereto. Bucket engagement latches 121, on the other hand, are not ordinarily provided with a preexisting loader bucket 12, and so need to be welded on as part of the process of retrofitting a preexisting loader bucket 12 for use in combination with loader bucket extender 11. From this viewpoint, the embodiment of FIG. 5 is preferred.

Of course, a wide range of other variations for attaching preexisting loader bucket 12 with loader bucket extender 11 can be developed based on this disclosure by someone of ordinary skill, and are encompassed by this disclosure and its associated claims. The embodiment of FIG. 5, for example, or similar embodiments to FIG. 5, may be advantageous if, for example, one is placing loader bucket extender 11 onto a plow-to-bucket converter such as disclosed in U.S. Pat. No. 4,890,400. The bucket extender 11 embodiment of FIG. 5 can more easily be attached without the need to rotate preexisting loader bucket 12 in or opposite the direction of rotation 405, and since a plow may not enable this sort of rotation to the same degree that a vehicle designed at the outset for loading, embodiments which avert the need to orient preexisting loader bucket 12 in the manner illustrated toward the left and center sides of FIGS. 4 and 5 are helpful in this regard.

While only certain preferred features of the invention have been illustrated and described, many modifications and changes will occur to those skilled in the art. It is, therefore, to be understood that the appended claims are intended to cover all such modifications and changes as fall within the true spirit of the invention.

I claim:

1. A system for extending a load-carrying capacity of a preexisting loader bucket, said system comprising:

a loader bucket extender completely separate and distinct from said preexisting loader bucket; and engagement and attachment means for engaging and attaching said loader bucket extender to said preexisting loader bucket around a periphery of said preexisting loader bucket; wherein:

an unextended original volume of said preexisting loader bucket designated by $V_1$ is substantially non-zero; and a height of said preexisting loader bucket designated by $h_1$ is substantially non-zero; whereby:

if an extended volume of said preexisting loader bucket and loader bucket extender when they are so-attached is designated by $V_2$;

if $b_1$ designates a base of said preexisting loader bucket;

if $b_2$ designates a base of said loader bucket extender; and if $h_2$ designates a combined height of said preexisting loader bucket and loader bucket extender when they are so-attached; then the extended load-carrying capacity achieved by so-attaching said loader bucket extender to said preexisting loader bucket is approximately given by $V_2/V_1 \sim b_2/b_1^2 \sim h_2^2/h_1^2$.

2. The system of claim 1, said loader bucket extender comprising:

upper wall bucket engagement means for engaging and attaching said loader bucket extender to said preexisting loader bucket along an upper wall of said loader bucket extender, as part of said engagement and attachment means; and lower wall bucket engagement means for engaging and attaching said loader bucket extender to said preexisting loader bucket along a lower wall of said loader bucket extender, as part of said engagement and attachment means.

3. The system of claim 2, said loader bucket extender further comprising:

side wall bucket engagement means for engaging and attaching said loader bucket extender to said preexisting loader bucket along side walls of said loader bucket extender, as part of said engagement and attachment means.

4. The system of claim 2, said system further comprising said preexisting loader bucket;

said preexisting loader bucket comprising:

upper wall bucket extender engagement means mating with said upper wall bucket engagement means, for engaging and attaching said preexisting loader bucket to said loader bucket extender along an upper wall of said loader bucket and said upper wall of said loader bucket extender, as part of said engagement and attachment means; and lower wall bucket extender engagement means mating with said lower wall bucket engagement means, for engaging and attaching said preexisting loader bucket to said loader bucket extender along a lower wall of said loader bucket and said lower wall of said loader bucket extender, as part of said engagement and attachment means.

5. The system of claim 4, said preexisting loader bucket further comprising:

side wall bucket extender engagement means mating with said side wall bucket engagement means, for engaging and attaching said preexisting loader bucket to said loader bucket extender along side walls of said loader bucket and said side walls of said loader bucket extender, as part of said engagement and attachment means.

6. The system of claim 2, said upper wall bucket engagement means comprising at least one bucket attachment engagement bar.

7. The system of claim 4, said upper wall bucket engagement means comprising at least one bucket attachment engagement bar.

8. The system of claim 2, said upper wall bucket engagement means comprising at least one slidable bucket engagement bar.

9. The system of claim 4, said upper wall bucket engagement means comprising at least one slidable bucket engagement bar.

10. The system of claim 3, said side wall bucket engagement means comprising at least one bucket attachment side wall securing aperture.

11. The system of claim 5, said side wall bucket engagement means comprising at least one bucket attachment side wall securing aperture.

12. The system of claim 2, said lower wall bucket engagement means comprising at least one bucket attachment securing arm with at least one rear wall securing aperture thereof.

13. The system of claim 4, said lower wall bucket engagement means comprising at least one bucket attachment securing arm with at least one rear wall securing aperture thereof.

14. The system of claim 4, said upper wall bucket engagement means comprising at least one bucket attachment engagement bar; and said upper wall bucket extender engagement means comprising at least one bucket engagement latch mating with one of said at least one bucket attachment engagement bars; whereby:

said mating of said at least one bucket engagement latch with one of said at least one bucket attachment engagement bar is achieved solely by orienting and moving said preexisting loader bucket with respect to said loader bucket extender, such that the combined assembly of said loader bucket with said loader bucket extender is thereby capable of being lifted without any further action beyond said orienting and moving, due to said mating of said at least one bucket engagement latch with said at least one bucket attachment engagement bar.

15. The system of claim 4, said upper wall bucket engagement means comprising at least one slidable bucket engagement bar; and said upper wall bucket extender engagement means comprising at least one bucket extender engagement eyelets mating with one of said at least one slidable bucket engagement bars by sliding said at least one slidable bucket engagement bar through said at least one bucket extender engagement eyelet.

16. The system of claim 5, said side wall bucket engagement means comprising at least one bucket attachment side wall securing aperture; and said side wall bucket extender engagement means comprising at least one loader bucket side wall securing aperture aligning with and attaching to one of said at least one bucket attachment side wall securing apertures.

17. The system of claim 4, said lower wall bucket engagement means comprising at least one bucket attachment securing arm with at least one rear wall securing aperture thereof; and said lower wall bucket extender engagement means comprising at least one rear wall securing eyelet aligning with and attaching to one of said at least one rear wall securing apertures.

18. The system of claim 3, said loader bucket extender further comprising a reinforcement bar running from said side wall bucket engagement means to a lower front region of said loader bucket extender.

19. The system of claim 4, said upper wall bucket engagement means comprising at least one bucket attachment engagement bar;

said upper wall bucket extender engagement means comprising at least one bucket engagement latch mating with one of said at least one bucket attachment engagement bars; and said lower wall bucket engagement means comprising at least one bucket attachment securing arm; whereby:

said mating of said at least one bucket engagement latch with one of said at least one bucket attachment engagement bar is achieved solely by orienting and moving said preexisting loader bucket with respect to said loader bucket extender in a manner further causing said at least one bucket attachment securing arm to slide into and contact said preexisting loader bucket proximate a lower wall of said preexisting loader bucket, such that the combined assembly of said loader bucket with said loader bucket extender is thereby capable of being lifted without any further action beyond said orienting and moving, due to said mating of said at least one bucket engagement latch with said at least one bucket attachment engagement bar, and said contact made between said at least one bucket attachment securing arm and said lower wall of said preexisting loader bucket.

20. A method for extending a load-carrying capacity of a preexisting loader bucket, comprising the step of engaging and attaching a loader bucket extender completely separate and distinct from said preexisting loader bucket to said preexisting loader bucket around a periphery of said preexisting loader bucket, using engagement and attachment means; wherein an unextended original volume of said preexisting loader bucket designated by $V_1$ is substantially non-zero; and a height of said preexisting loader bucket designated by $h_1$ is substantially non-zero; whereby:

if an extended volume of said preexisting loader bucket and loader bucket extender when they are so-attached is designated by $V2_2$;

if $b_1$ designates a base of said preexisting loader bucket;

if $b_2$ designates a base of said loader bucket extender; and if $h_2$ designates a combined height of said preexisting loader bucket and loader bucket extender when they are so-attached; then the extended load-carrying capacity achieved by so-attaching said loader bucket extender to said preexisting loader bucket is approximately given by $V_2/V_1 \sim b_2^2/b_1^2 \sim h_2^2/h_1^2$.

21. The method of claim 20, said step of attaching a loader bucket extender to said preexisting loader bucket comprising the further steps of:

engaging and attaching said preexisting loader bucket to said loader bucket extender along an upper wall of said loader bucket and an upper wall of said loader bucket extender by mating upper wall bucket extender engagement means of said preexisting loader bucket with upper wall bucket engagement means of said loader bucket extender; and engaging and attaching said preexisting loader bucket to said loader bucket extender along a lower wall of said loader bucket and said lower wall of said loader bucket extender by mating lower wall bucket extender engagement means of said preexisting loader bucket with lower wall bucket engagement means of said loader bucket extender.

22. The method of claim 21, said step of attaching a loader bucket extender to said preexisting loader bucket comprising the further steps of:

engaging and attaching said preexisting loader bucket to said loader bucket extender along side walls of said loader bucket and side walls of said loader bucket extender by mating side wall bucket extender engagement means of said preexisting loader bucket with said side wall bucket engagement means of said loader bucket extender.

23. The method of claim 22, said step of engaging and attaching said preexisting loader bucket to said loader bucket extender along an upper wall of said loader bucket and an upper wall of said loader bucket extender comprising the further steps of:

resting a lower front region of said loader bucket extender upon a supporting surface and orienting said upper wall of said loader bucket extender substantially horizontally above said supporting surface;

raising said preexisting loader bucket above said loader bucket extender and rotationally orienting said preexisting loader bucket such that recessed sections of said at least one bucket engagement latch are oriented substantially upwards;

lowering said preexisting loader bucket to a position wherein said at least one bucket engagement latch drops below at least one bucket attachment engagement bar of said loader bucket extender; and raising said preexisting loader bucket until said at least one bucket engagement latch firmly engages and mates with said at least one bucket attachment engagement bar; whereby:

said mating of said at least one bucket engagement latch with one of said at least one bucket attachment engagement bar is achieved solely by orienting and moving said preexisting loader bucket with respect to said loader bucket extender according to said resting, raising, lowering and raising steps, such that the combined assembly of said loader bucket with said loader bucket extender is thereby capable of being lifted without any further steps beyond said resting, raising, lowering and raising steps, due to said mating of said at least one bucket engagement latch with said at least one bucket attachment engagement bar.

24. The method of claim 22, said step of engaging and attaching said preexisting loader bucket to said loader bucket extender along an upper wall of said loader bucket and an upper wall of said loader bucket extender comprising the further steps of:

resting a lower front region of said loader bucket extender upon a supporting surface and orienting said upper wall of said loader bucket extender substantially horizontally above said supporting surface;

raising said preexisting loader bucket above said loader bucket extender and rotationally orienting said preexisting loader bucket such that recessed sections of said at least one bucket engagement latch are oriented substantially upwards;

lowering said preexisting loader bucket to a position wherein said at least one bucket engagement latch drops below at least one bucket attachment engagement bar of said loader bucket extender, and wherein at least one bucket attachment securing arm of said loader bucket extender slides into and contacts said preexisting loader bucket proximate a lower wall of said preexisting loader bucket; and raising said preexisting loader bucket until said at least one bucket engagement latch firmly engages and mates with said at least one bucket attachment engagement bar;

said steps of engaging and attaching said preexisting loader bucket to said loader bucket extender along side walls of said loader bucket and side walls of said loader bucket extender and of engaging and attaching said preexisting loader bucket to said loader bucket extender along a lower wall of said loader bucket and said lower wall of said loader bucket extender comprise the further steps of:

once said at least one bucket engagement latch firmly engages and mates with said at least one bucket attachment engagement bar and said at least one bucket attachment securing arm of said loader bucket extender has been slid into said preexisting loader bucket proximate said lower wall of said preexisting loader bucket, rotating said preexisting loader bucket and said loader bucket extender in combination, into an orientation wherein said lower wall of said loader bucket and said lower wall of said loader bucket extender are oriented substantially horizontally, wherein at least one rear wall securing aperture of said at least one bucket attachment securing arm becomes fully aligned with at least one rear wall securing eyelet of said preexisting loader bucket, and wherein at least one bucket attachment side wall securing aperture of said at least one loader bucket extender becomes fully aligned with at least one loader bucket side wall securing aperture of said preexisting loader bucket;

securing said at least one bucket attachment side wall securing aperture and said at least one loader bucket side wall securing aperture to one another using side wall securing means; and securing said at least one rear wall securing aperture and said at least one rear wall securing eyelet to one another using rear wall securing means; whereby:

said mating of said at least one bucket engagement latch with one of said at least one bucket attachment engagement bar is achieved solely by orienting and moving said preexisting loader bucket with respect to said loader bucket extender in a manner further causing said at least one bucket attachment securing arm to slide into and contact said preexisting loader bucket proximate a lower wall of said preexisting loader bucket, such that the combined assembly of said loader bucket with said loader bucket extender is thereby capable of being lifted without any further action beyond said orienting and moving, due to said mating of said at least one bucket engagement latch with said at least one bucket attachment engagement bar, and said contact made between said at least one bucket attachment securing arm and said lower wall of said preexisting loader bucket.

25. The method of claim 21, said step of engaging and attaching said preexisting loader bucket to said loader bucket extender along an upper wall of said loader bucket and an upper wall of said loader bucket extender comprising the further steps of: moving said preexisting loader bucket to a position wherein at least one bucket extender engagement eyelet of said preexisting bucket is aligned with at least one slidable bucket engagement bar of said loader bucket extender; and sliding said at least one slidable bucket engagement bar through said at least one bucket extender engagement eyelet.

26. The method of claim 23, said step of engaging and attaching said preexisting loader bucket to said loader bucket extender along an upper wall of said loader bucket and an upper wall of said loader bucket extender comprising the further steps of:

moving said preexisting loader bucket to a position wherein at least one bucket extender engagement eyelet of said preexisting bucket is aligned with at least one slidable bucket engagement bar of said loader bucket extender, and wherein at least one bucket attachment securing arm of said loader bucket extender slides into said preexisting loader bucket proximate a lower wall of said preexisting loader bucket; and sliding said at least one slidable bucket engagement bar through said at least one bucket extender engagement eyelet;

said steps of engaging and attaching said preexisting loader bucket to said loader bucket extender along side walls of said loader bucket and side walls of said loader bucket extender and of engaging and attaching said preexisting loader bucket to said loader bucket extender along a lower wall of said loader bucket and said lower wall of said loader bucket extender comprise the further steps of:

once said at least one bucket engagement latch firmly engages and mates with said at least one bucket attachment engagement bar and said at least one bucket attachment securing arm of said loader bucket extender has been slid into said preexisting loader bucket proximate said lower wall of said preexisting loader bucket, rotating said preexisting loader bucket and said loader bucket extender in combination, into an orientation wherein said lower wall of said loader bucket and said lower wall of said loader bucket extender are oriented substantially horizontally, wherein at least one rear wall securing aperture of said at least one bucket attachment securing arm becomes fully aligned with at least one rear wall securing eyelet of said preexisting loader bucket, and wherein at least one bucket attachment side wall securing aperture of said at least one loader bucket extender becomes fully aligned with at least one loader bucket side wall securing aperture of said preexisting loader bucket;

securing said at least one bucket attachment side wall securing aperture and said at least one loader bucket side wall securing aperture to one another using side wall securing means; and securing said at least one rear wall securing aperture and said at least one rear wall securing eyelet to one another using rear wall securing means.

27. The method of claim 22, comprising the further step of providing a reinforcement bar of said loader bucket extender, running from said side wall bucket engagement means to a lower front region of said loader bucket extender.

* * * * *